US012012743B2

(12) United States Patent
Keller et al.

(10) Patent No.: US 12,012,743 B2
(45) Date of Patent: Jun. 18, 2024

(54) DEVICE FOR THERMALLY INSULATING, FORCE-TRANSMITTING RETROFITTING OF A SECOND LOAD-BEARING CONSTRUCTION ELEMENT TO A FIRST LOAD-BEARING CONSTRUCTION ELEMENT AND STRUCTURE WITH SUCH A DEVICE

(71) Applicant: HALFEN GmbH, Langenfeld (DE)

(72) Inventors: Tina Keller, Querfurt (DE); Thorsten Heidolf, Weimar (DE); Lutz Hollerbuhl, Sangerhausen (DE); Richard Morsink, Enschede (NL)

(73) Assignee: Leviat GmbH, Langenfeld (DE)

( * ) Notice: Subject to any disclaimer, the term of this patent is extended or adjusted under 35 U.S.C. 154(b) by 285 days.

(21) Appl. No.: 17/582,182

(22) Filed: Jan. 24, 2022

(65) Prior Publication Data

US 2022/0243451 A1 Aug. 4, 2022

(30) Foreign Application Priority Data

Feb. 1, 2021 (DE) ..... 20 2021 000 466.1

(51) Int. Cl.
*E04B 1/76* (2006.01)
*E04B 1/00* (2006.01)

(52) U.S. Cl.
CPC ..... *E04B 1/0038* (2013.01); *E04B 1/76* (2013.01)

(58) Field of Classification Search
CPC ..... E04B 1/0038; E04B 1/76
(Continued)

(56) References Cited

U.S. PATENT DOCUMENTS 2,321,813 A * 6/1943 Henzel ..... F27D 1/141 52/669
4,959,940 A * 10/1990 Witschi ..... E04B 1/0038 52/223.13

(Continued)

FOREIGN PATENT DOCUMENTS

DE 10 2005 012 862 1/2006
DE 10 2008 061 009 6/2010

(Continued)

*Primary Examiner* — James J Buckle, Jr.
(74) *Attorney, Agent, or Firm* — Gudrun E. Huckett

(57) ABSTRACT

A device for retrofitting a second load-bearing construction element to a first load-bearing construction element has an insulation body arranged between the construction elements. Tensile force-transmitting, compressive force-transmitting, and shear force-transmitting elements are provided. The compressive force-transmitting elements include a contact surface, accessible from a longitudinal side of the insulation body, for absorbing horizontal compressive forces of the second load-bearing construction element. The shear force transmitting elements include a support surface, accessible from the longitudinal side of the insulation body, for absorbing vertically oriented forces of the second load-bearing construction element and further include a shear rod connected to the support surface. A support angle bracket has first and second legs and a transversely arranged cheek connecting the first and second legs. The first leg forms the contact surface. The second leg forms the support surface. The shear rod has a slanted section fixed directly to the cheek.

20 Claims, 7 Drawing Sheets

(58) Field of Classification Search
USPC ..... 52/405.3, 583.1
See application file for complete search history.

(56) References Cited

U.S. PATENT DOCUMENTS

| | | | | | |
|---|---|---|---|---|---|
| 5,005,331 | A * | 4/1991 | Shaw | F16B 13/141 | 52/704 |
| 5,678,952 | A * | 10/1997 | Shaw | E01C 11/14 | 404/136 |
| 8,733,052 | B2 * | 5/2014 | Froehlich | E04B 1/0038 | 52/407.3 |
| 8,973,317 | B2 * | 3/2015 | Larkin | E04C 5/16 | 52/223.14 |
| 2008/0010913 | A1 * | 1/2008 | Fritschi | E04B 1/0038 | 52/167.1 |
| 2019/0093351 | A1 * | 3/2019 | Michiels | E04B 1/0038 | |
| 2023/0411098 | A1 * | 12/2023 | Ao | H01H 71/10 | |

FOREIGN PATENT DOCUMENTS

| | | |
|---|---|---|
| EP | 0 750 076 | 12/1996 |
| EP | 3 056 620 | 8/2016 |
| WO | 2017/086777 | 5/2017 |

* cited by examiner

Fig. 7
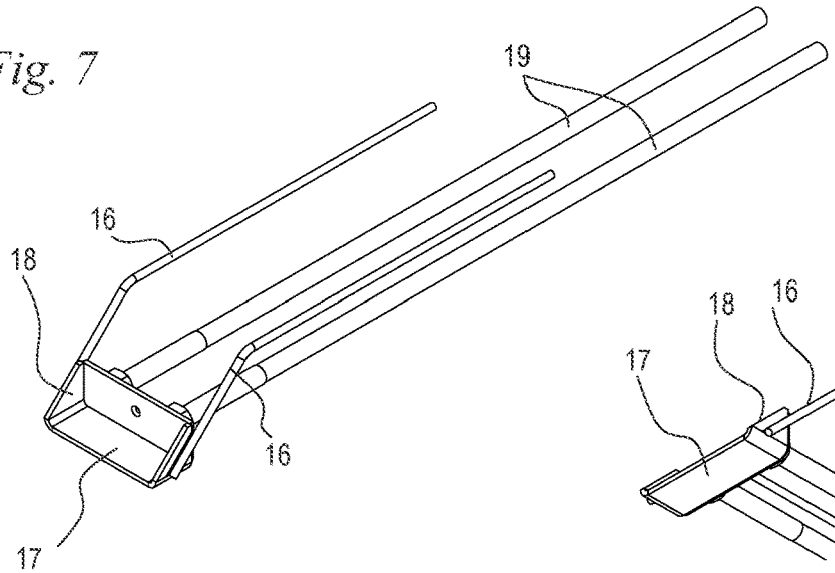
Fig. 8
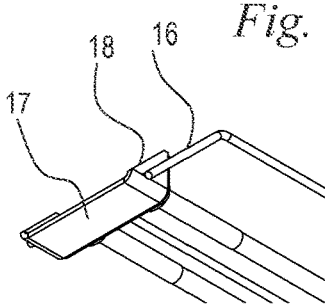
Fig. 9
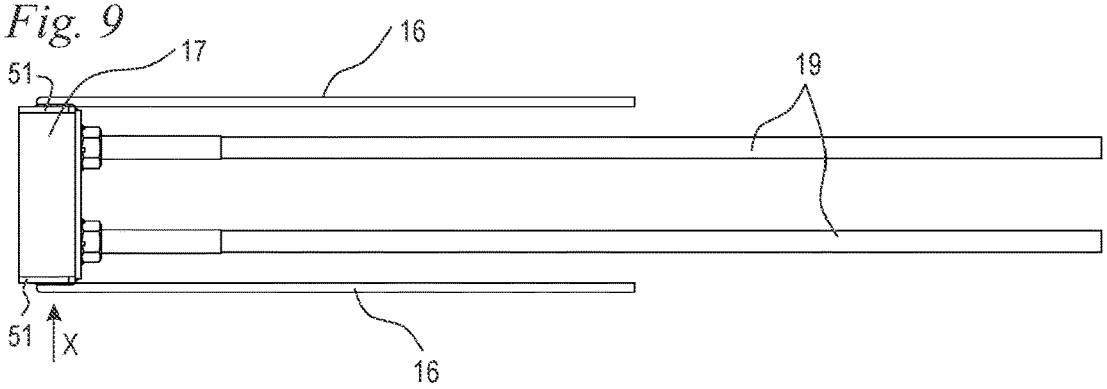
Fig. 10
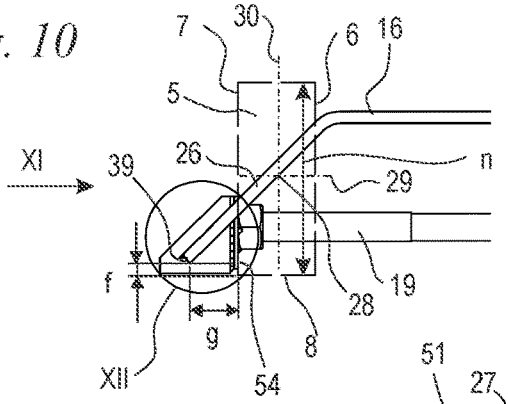
Fig. 11
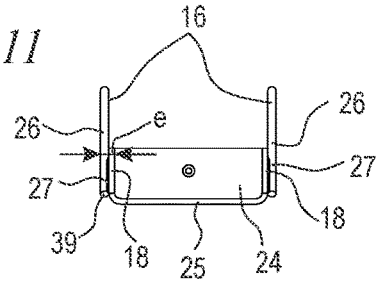
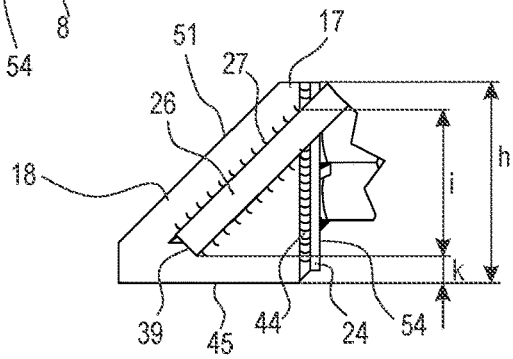
Fig. 12

DEVICE FOR THERMALLY INSULATING, FORCE-TRANSMITTING RETROFITTING OF A SECOND LOAD-BEARING CONSTRUCTION ELEMENT TO A FIRST LOAD-BEARING CONSTRUCTION ELEMENT AND STRUCTURE WITH SUCH A DEVICE

BACKGROUND OF THE INVENTION

The invention relates to a device for thermally insulating, force-transmitting retrofitting of a second load-bearing construction element to a first load-bearing construction element, in particular a building ceiling and a balcony slab, as well as a structure with such a device.

DE 10 2005 012 862 A1 discloses a structural element that serves for connecting two steel reinforced concrete components. An angle bracket is provided on which one of the steel reinforced concrete components is supported so that the connection device engages from below the steel reinforced concrete component. Shear rods are fixed to the angle bracket. The slanted section of the shear rods is arranged in the expansion joint between the construction elements. The shear rods project through openings in the rear wall of the angle bracket and are fixed to a support plate of the angle bracket. This provides for a comparatively complex configuration of the connection device.

The present invention has the object of providing a device for thermally insulating, force-transmitting retrofitting of a second load-bearing construction element to a first load-bearing construction element, that comprises a simple configuration and enables a beneficial shear force transmission. A further object of the present invention resides in providing an advantageous structure with such a device.

SUMMARY OF THE INVENTION

This object is solved with respect to the device for thermally insulating, force-transmitting retrofitting of a second load-bearing construction element to a first load-bearing construction element by a device comprising an insulation body for arrangement in a construction joint between the first construction element and the second construction element as well as tensile force-transmitting means, compressive force-transmitting means, and shear force-transmitting means, wherein the insulation body comprises a first longitudinal side provided for arrangement at the first construction element and an oppositely positioned second longitudinal side, wherein the insulation body comprises a length direction, a transverse direction extending perpendicularly to the length direction and running from the first longitudinal side to the second longitudinal side, and an upright direction extending perpendicularly to the length direction and perpendicularly to the transverse direction, wherein the compressive force-transmitting means comprise a contact surface accessible from the second longitudinal side for absorbing horizontal compressive forces of the second construction element and at least one compressive force element extending at least to the first longitudinal side and force-transmittingly connected to the contact surface, wherein the shear force transmitting means comprise a support surface accessible from the second longitudinal side for absorbing vertically oriented forces of the second construction element and at least one shear rod connected force-transmittingly to the support surface, wherein the contact surface is formed at a first leg and the support surface at a second leg of a support angle bracket, wherein the first leg and the second leg of the support angle bracket are connected by at least one cheek arranged transversely to the length direction, wherein the shear rod comprises a slanted section extending at a slant to the upright direction, wherein the at least one shear rod is fixed with its slanted section directly to the cheek.

In respect to the structure, the object is solved by a structure that comprises a first load-bearing construction element and a second load-bearing construction element of concrete, in particular a building ceiling and a balcony slab, and a device for thermally insulating, force-transmitting retrofitting of a second load-bearing construction element to a first load-bearing construction element, in particular a balcony slab to a building ceiling, wherein the device comprises an insulation body for arrangement in a construction joint between the first construction element and the second construction element as well as tensile force-transmitting means, compressive force-transmitting means, and shear force-transmitting means, wherein the insulation body comprises a first longitudinal side provided for arrangement at the first construction element and an oppositely positioned second longitudinal side, wherein the insulation body comprises a length direction, a transverse direction extending perpendicularly to the length direction and running from the first longitudinal side to the second longitudinal side, and an upright direction extending perpendicularly to the length direction and perpendicularly to the transverse direction, wherein the compressive force-transmitting means comprise a contact surface accessible from the second longitudinal side for absorbing horizontal compressive forces of the second construction element and at least one compressive force element extending at least to the first longitudinal side and force-transmittingly connected to the contact surface, wherein the shear force transmitting means comprise a support surface accessible from the second longitudinal side for absorbing vertically oriented forces of the second construction element and at least one shear rod connected force-transmittingly to the support surface, wherein the contact surface is formed at a first leg and the support surface at a second leg of a support angle bracket, wherein the first leg and the second leg of the support angle bracket are connected by at least one cheek arranged transversely to the length direction, wherein the shear rod comprises a slanted section extending at a slant to the upright direction, wherein the at least one shear rod is fixed with its slanted section directly to the cheek, wherein the insulation body is arranged in the construction joint between the first construction element and the second construction element, wherein the first longitudinal side of the insulation body is arranged at the first construction element, wherein the second construction element is supported on the contact surface and the support surface in relation to the first construction element, and wherein the section of the shear rod projecting past the insulation body into the first construction element is embedded in the concrete of the first construction element.

It is provided that, for transmitting compressive forces and shear forces, a support angle bracket is provided that comprises a contact surface for transmitting the compressive forces and a support surface for absorbing the vertical shear forces. Since the compressive forces and the shear forces are transmitted via a support surface and via a contact surface, a retrofitting installation of the second construction element is possible in a simple manner by placement onto the support angle bracket. In order to provide a good introduction of the shear forces, it is provided that the two legs of the support angle bracket are connected by at least one cheek which is arranged transversely to the length direction of the insulation body. The shear rod is fixed directly to the cheek by means of its slanted section which is extending at a slant to the upright direction. The shear rod projects in this way with its slanted section past the contact surface in the direction toward the second construction element. In this way, the force introduction of the shear forces can be realized at a comparatively large distance in relation to the first construction element. At the same time, the fixation of the shear rod at the cheek provides for a simple and stable possibility of fixation. The cheek effects at the same time a stabilization of the angle bracket and enables a positional securing action of the second construction element in relation to the first construction element in length direction of the insulation body. In this context, the cheek must not extend to the joining region of the support angle bracket where the two legs of the support angle bracket abut each another but can have a cutout in the area of the joining region. The positioning of the second construction element at the first construction element during mounting of the second construction element as a prefabricated finished part at the first construction element is possible in a simple manner.

The device is designed such that a retrofitting joining of the second construction element at the first construction element is enabled. In this context, "retrofitting" means that the first construction element and the second construction element can be manufactured separate from each other, in particular of concrete, and that the device is configured such that it is possible to join the construction elements to each other after their manufacture, i.e., in particular after the concrete of the construction elements has solidified. A retrofitting joining is not possible, for example, when a reinforcement part must be embedded in the concrete of both construction elements.

It has been found that it is advantageous for a good force introduction when the distance of the end of the slanted section of the shear rod facing away from the first longitudinal side in relation to the bottom side of the insulation body is as small as possible. In this way, forces can be introduced approximately at the level of the bottom side of the insulation body. Usually, the bottom side of the second construction element is arranged approximately at the level of the bottom side of the insulation body so that the force introduction can be realized near the bottom side of the second construction element due to the described arrangement. Preferably, the distance measured in upright direction of the end of the slanted section of the shear rod arranged at the cheek in relation to the bottom side of the insulation body amounts to less than 5 cm, in particular less than 2 cm. The other end of the slanted section is advantageously arranged in the insulation body, or the slanted section projects completely through the insulation body. In particular in case of comparatively tall insulation bodies, the distance of the end of the slanted section of the shear rod in relation to the bottom side of the insulation body can also be designed larger. Advantageously, the distance of the end of the slanted section of the shear rod arranged at the cheek in relation to the underside of the insulation body amounts to at most one fourth of the height of the insulation body.

The end of the slanted section of the shear rod arranged at the cheek and facing away from the first longitudinal side is preferably positioned at a distance as large as possible in relation to the first construction element in order to enable a beneficial force introduction.

The end of the slanted section of the shear rod arranged at the cheek and facing away from the first longitudinal side comprises advantageously a distance in relation to the insulation body that is measured in transverse direction and amounts to at least 2 cm, in particular at least 5 cm. The end of the slanted section of the shear rod facing away from the first longitudinal side and arranged at the cheek comprises advantageously a distance in relation to a rear side of the first leg facing away from the second leg that is measured in transverse direction and amounts to at least 2 cm, in particular at least 5 cm. In case of an arrangement of the support angle bracket at the second longitudinal side of the insulation body, the distance in relation to the insulation body corresponds to the distance to the rear side of the first leg.

Advantageously, the distance measured in the upright direction of the end of the slanted section of the shear rod facing away from the first longitudinal side in relation to the underside of the insulation body is smaller than the distance measured in transverse direction of this end in relation to the insulation body. Preferably, the distance measured in upright direction of this end in relation to the bottom side of the insulation body amounts to less than 80%, in particular less than 50%, of the distance measured in transverse direction of this end in relation to the insulation body.

In a particularly advantageous configuration, the slanted section of the shear rod is welded to the cheek. Another type of fastening can also be provided however.

An advantageous configuration results when two cheeks are arranged at oppositely positioned ends of the support angle bracket and a shear rod is fixed, respectively, to the oppositely positioned cheeks. In this way, a good distribution of the introduced shear force onto the two shear rods and a symmetric force introduction are enabled.

Advantageously, the support angle bracket is comprised of metal. Particularly preferred, the support angle bracket including the at least one cheek is made of sheet metal, in particular by stamping, bending, and welding.

In a preferred embodiment variant, the support angle bracket projects in the direction toward the second construction element past the insulation body. In a viewing direction in the length direction, the support angle bracket is positioned advantageously at most partially in overlap with the insulation body. Particularly preferred, the support angle bracket in the viewing direction in the length direction is not in overlap with the insulation body. In an alternative advantageous configuration, it can however be provided that the insulation body comprises a cutout in which the support angle bracket is partially or completely arranged. This is in particular advantageous when a comparatively wide expansion joint is to be bridged.

It can be provided that the second construction element is supported with its concrete directly on the support angle bracket. For an improved force introduction, it is in particular provided that the device comprises a bearing part, in particular a bearing angle bracket that is provided for embedding in the second construction element. The bearing part comprises advantageously a first bearing surface for transmitting compressive forces oriented in the transverse direction as well as a second bearing surface for transmitting shear forces oriented in upright direction toward the support angle bracket. The bearing part can contact directly the support angle bracket in this context. However, intermediate positioning of further elements between the bearing part and the support angle bracket can be provided also.

In order to enable a good force transmission between the bearing part and the second construction element, advantageously at least one reinforcement element is fixed at the bearing part. The reinforcement element is preferably a compression rod which is to be embedded in the concrete of the second construction element.

In order to enable the placement of the second construction element on the support angle bracket, it is advantageously provided that the second construction element comprises recesses for the cheeks of the support angle bracket. In order to be able to produce these recesses in a simple way, it is advantageously provided that the device comprises a formwork body that comprises at least one recess for receiving the at least one cheek and the section of the shear rod arranged thereat. The formwork body is preferably provided for remaining within the second construction element. However, it can also be provided that the formwork body, prior to connecting the second construction element to the first construction element, is removed from the second construction element.

The formwork body comprises advantageously a first surface for support on the contact surface and a second surface for support on the support surface. The bearing part, in particular the bearing angle bracket, is supported advantageously at the formwork body such that the force transmission between the construction elements is realized from the bearing part through the formwork body into the support angle bracket. When the formwork body comprises two recesses, it is advantageously provided that the length of the bearing part measured in length direction of the insulation body is smaller than the distance between the two recesses of the formwork body. In this way, the bearing part can be positioned easily at the formwork body. Particularly preferred, the length of the bearing part measured in length direction of the insulation body is at most 1 cm smaller than the distance between the two recesses of the formwork body. The length of the bearing part corresponds advantageously to the distance between the two recesses minus twice the wall thickness of the formwork body.

The device comprises tensile force-transmitting means for transmitting tensile forces between the two construction elements. Advantageously, the tensile force-transmitting means comprise first tension rods and second tension rods. In this context, the first tension rods are advantageously provided for embedding in the first construction element and the second tension rods are provided for embedding in the second construction element. The first and second tension rods extend advantageously substantially on opposite sides of the insulation body. Advantageously, either the first tension rods or the second tension rods extend through the insulation body. The first tension rods are advantageously connected in a force-transmitting way to the second tension rods. The force-transmitting connection of the tension rods with each other is advantageously arranged outside of the insulation body. In a particularly preferred configuration, the first tension rods and the second tension rods are arranged in a common plane which extends perpendicularly to the upright direction. This enables an advantageous force transmission.

A simple configuration results when the first tension rods and the second tension rods are fixed to a common connection plate. The first and second tension rods can be connected, for example, by screw connections or by weld connections to the connection plate. Preferably, at least the connection of the first tension rods or the connection of the second tension rods to the connection plate is releasable so that a retrofitting connection of the second construction element to the first construction element is possible in a simple manner simply by attaching the second construction element and producing the screw connections. The second construction element can be manufactured completely in a prefabrication plant, and no cast-in-place concrete, injection mortar or the like is required at the construction site for connecting the second construction element, delivered in the finished state, to the first construction element.

For a structure, it is provided that the structure comprises a first load-bearing construction element of concrete and a second load-bearing construction element of concrete as well as a device for connecting the second load-bearing construction element to the first load-bearing construction element. The insulation body of the device is arranged in a construction joint between the first construction element and the second construction element. The first longitudinal side of the insulation body is arranged at the first construction element. The second construction element is supported at the contact surf ace and the support surface of the support angle bracket in relation to the first construction element. The section of the shear rod projecting past the insulation body in the first construction element is embedded in the concrete of the first construction element. The structure is advantageously produced in that the second construction element is manufactured in the prefabrication plant, is positioned at the construction site at the first construction element, and fixed at the first construction element only by joining the first and second tensile force-transmitting elements.

Advantageously, the support angle bracket in the viewing direction in the length direction of the insulation body is not in overlap with the insulation body. The second construction element comprises advantageously at least one recess which is open toward the bottom side and toward the end face of the second construction element and the at least one cheek of the support angle bracket projects into the recess.

Advantageously, the first construction element has embedded therein first tension rods and the second construction element has embedded therein second tension rods which are connected to each other at a connection plate which is arranged at one of the construction elements. The construction element that comprises the connection plate comprises advantageously, adjacent to the connection plate, cutouts in which tension rods, which are projecting from the other construction element through the insulation body and the connection plate, are screw-connected. The cutouts are in this context preferably arranged at the side of the connection plate which is facing away from the other construction element so that the tension rods can be fixed at the connection plate by means of nuts which are placed onto the tension rods and screwed thereon in the cutouts. In this way, a simple configuration is provided.

The tension rods of the device are preferably not connected to the compressive force-transmitting means and the shear force-transmitting means but are arranged separate from them. In this way, the height of the device can be adjusted in a simple manner by selecting an insulation body with desired height or by combining an insulation body from several elements until the corresponding desired height is achieved without further modifications at the force-transmitting elements being required. In this way, a simple and modular configuration of the device is achieved.

BRIEF DESCRIPTION OF THE DRAWING

Embodiments of the invention will be explained in the following with the aid of the drawing.

FIG. 7 shows the tensile force-transmitting and compressive force-transmitting elements of the device to be arranged at the first construction element in a perspective illustration.

FIG. 8 shows the tensile force-transmitting and compressive force-transmitting elements of the device to be arranged at the first construction element in another perspective illustration.

FIG. 9 shows the arrangement of FIGS. 7 and 8 in a plan view.

FIG. 10 shows the arrangement of FIG. 9 with schematically illustrated insulation body, viewed in the direction of arrow X in FIG. 9.

FIG. 11 is a side view in the direction of arrow XI in FIG. 10.

FIG. 12 shows the detail XII of FIG. 10 in an enlarged illustration.

DESCRIPTION OF THE PREFERRED EMBODIMENTS

Figure 1:
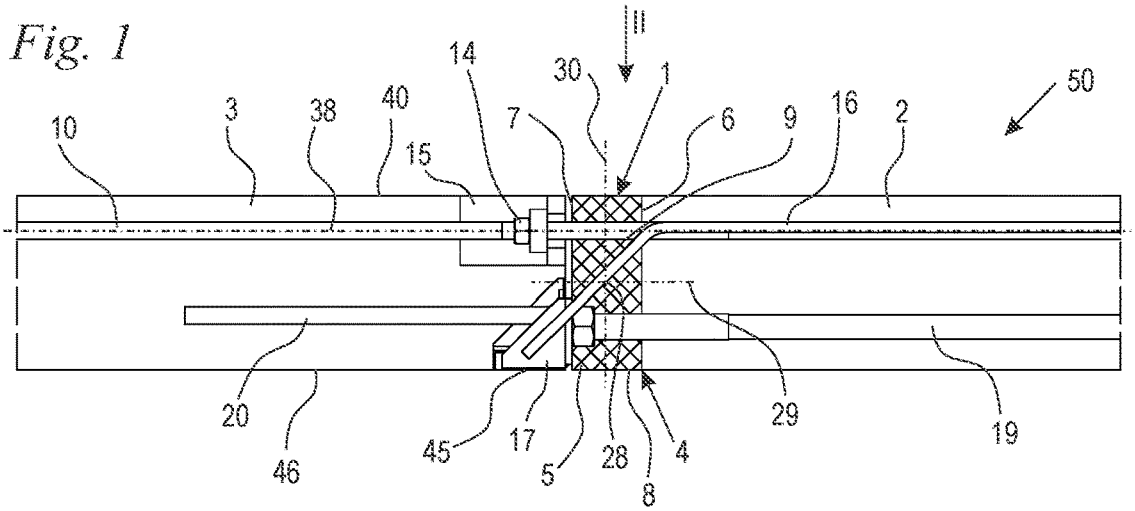
FIG. 1 is a schematic section illustration of a structure.

FIG. 1 shows schematically a detail of a structure 50. The structure 50 comprises a first construction element 2, in the embodiment a building ceiling, and a second construction element 3, in the embodiment a balcony slab. The second construction element 3 is joined by means of a thermally insulating component 1 to the first construction element 2 in a thermally insulating and force-transmitting way. The load-bearing construction elements 2 and 3 are made of concrete, in the embodiment of steel reinforced concrete. The load-bearing construction element 3 has been fixed after its manufacture to the first load-bearing construction element 2. In this way, the load-bearing construction element 3 can be manufactured, for example, in a prefabrication plant with high quality and can be fixed very quickly to the construction element 2 at the construction site so that crane time can be shortened and therefore production costs can be reduced.

The thermally insulating component 1 comprises an insulation body 5 which is arranged in a construction joint 4 between the first construction element 2 and the second construction element 3. The insulation body 5 comprises a first longitudinal side 6 arranged at the first construction element 2. The second oppositely positioned longitudinal side 7 extends next to the second construction element 3. In the embodiment, a narrow gap is formed between the insulation body 5 and the second construction element 3. However, it can also be provided that the second construction element 3 contacts the insulation body 5.

The insulation body 5 comprises a length direction 28 which is oriented in the length direction of the expansion joint 4. The length direction 28 extends preferably horizontally in the installed state. The insulation body 5 comprises an upright direction 30 which extends perpendicularly to the length direction 28. The upright direction 30 extends preferably vertically in the installed state. The insulation body 5 comprises a transverse direction 29 which extends from the first longitudinal side 6 to the oppositely positioned longitudinal side 7. The transverse direction 29 is oriented perpendicularly to the length direction 28 and perpendicularly to the upright direction 30. The transverse direction 29 extends preferably horizontally in the installed state.

The thermally insulating component 1 forms together with additional elements a device for force-transmitting connection of the second construction element 3 to the first construction element 2. The device is comprised of the thermally insulating component 1 that is fixed to the first construction element 2 as well as additional means for force transmission which are arranged at the second construction element 3. The means for force transmission arranged at the second construction element 3 are advantageously releasably connected to the means for force transmission arranged at the first construction element 2. In this way, a retrofitting connection of the second construction element 3 to the first construction element 2 is possible.

Figure 2:
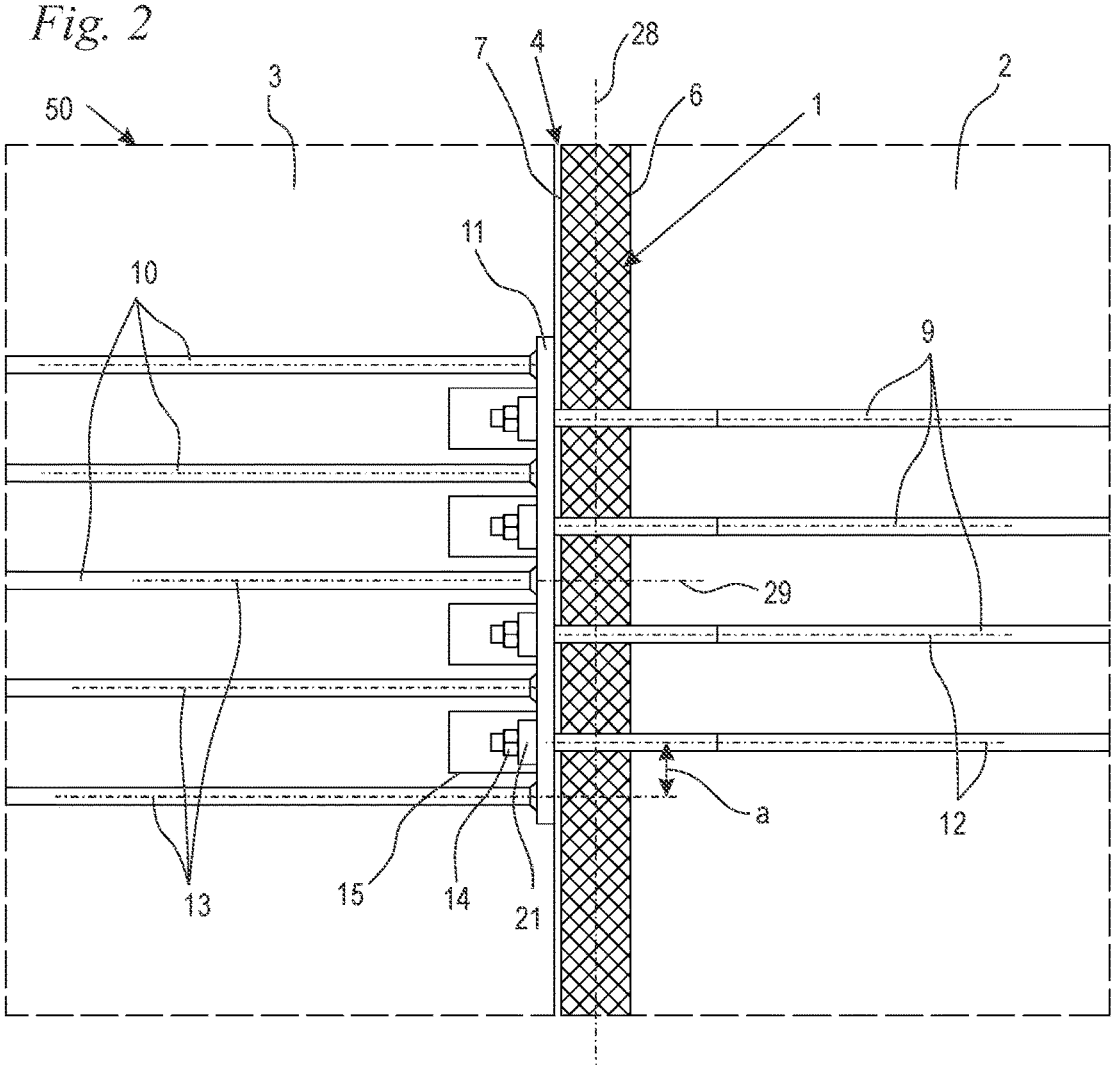
FIG. 2 is a partial schematic illustration of the tensile force transmitting means of the structure according to FIG. 1 in the viewing direction of arrow II in FIG. 1.
Figure 3:
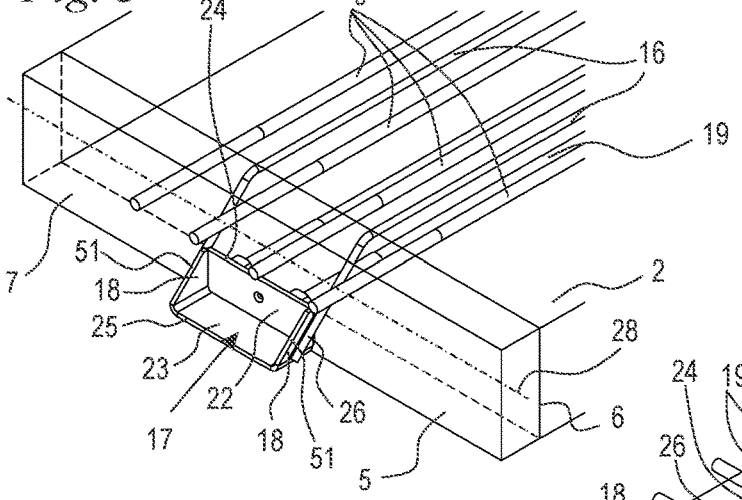
FIG. 3 is a schematic perspective illustration of the first construction element and of the elements of the device arranged at the first construction element.
Figure 4:
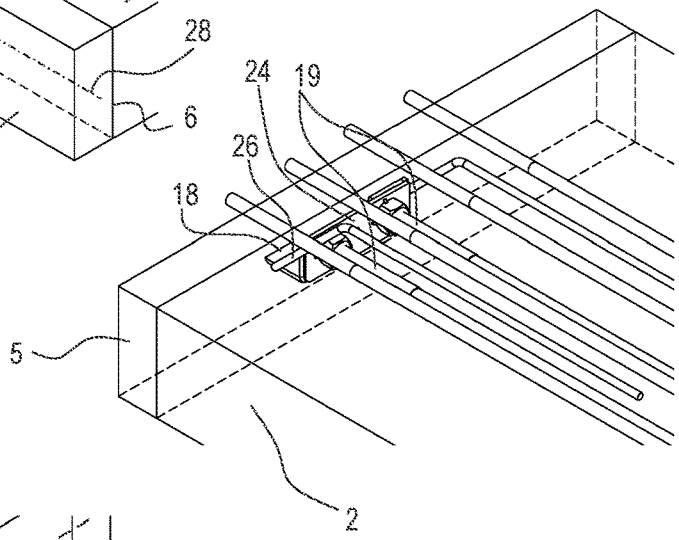
FIG. 4 is another schematic perspective illustration of the first construction element and of the elements of the device arranged at the first construction element.
Figure 5:
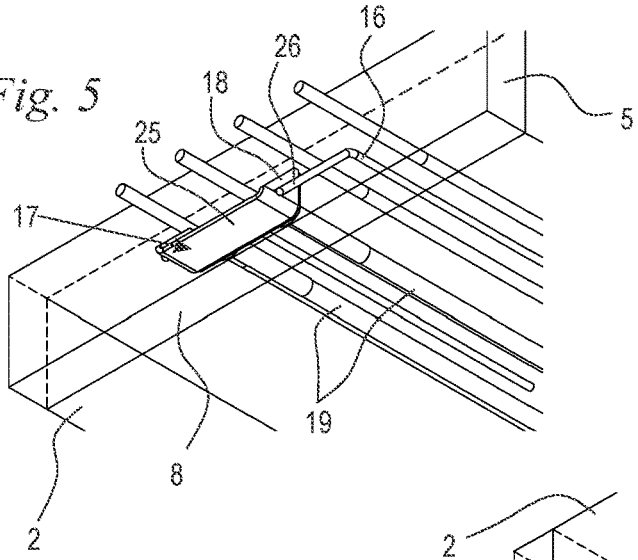
FIG. 5 is yet another schematic perspective illustration of the first construction element and of the elements of the device arranged at the first construction element.
Figure 6:
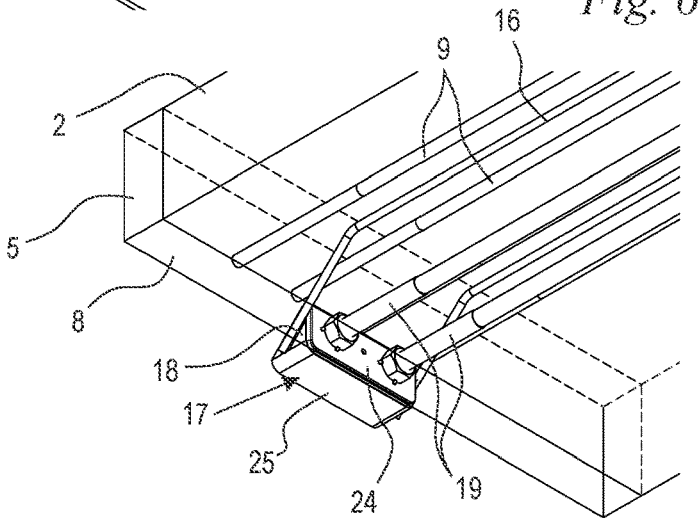
FIG. 6 is another schematic perspective illustration of the first construction element and of the elements of the device arranged at the first construction element.

For tensile force transmission between the construction elements 2 and 3, the device comprises first tension rods 9 that are embedded in the first construction element 2 as well as second tension rods 10 that are embedded in the second construction element 3. The tension rods 9 and 10 are connected to each other in a force-transmitting way. In this context, the force-transmitting connection of the tension rods 9 and 10 is provided outside of the insulation body 5 in the embodiment. In the embodiment according to FIG. 1, the first tension rods 9 project through the insulation body 5. At the top side 40 of the second construction element 3, cutouts 15 are provided. The tension rods 9 with their ends project into these cutouts 15. In this way, the ends of the tension rods 9 are accessible from the top side 40. The second tension rods 10 are fixedly connected to the connection plate 11 arranged at the second construction element 3, in the embodiment connected by weld connections (FIG. 2). The first tension rods 9 are screw-connected to the connection plate 11. For this purpose, in the cutouts 15 a fastening nut 14 is screwed onto the tension rods 9, respectively. In the embodiment, a washer 21 is arranged between the fastening nuts 14 and the connection plate 11, respectively. Since the cutouts 15 are open toward the top side 40 of the second construction element 3, the second construction element 3 can be placed with the connection plate 11 onto the tension rods 9 and can be fixed in a force-transmitting way to the first construction element 2 by fastening of the fastening nuts 14. The first tension rods 9 and the second tension rods 10 project away from the connection plate 11 at oppositely positioned sides.

For the transmission of compressive forces and shear forces, a support angle bracket 17 is arranged at the first construction element 2. The support angle bracket 17 forms advantageously a part of the thermally insulating component 1 and is in particular secured captively at the insulation body 5. The support angle bracket 17 is connected fixedly to the shear rods 16. The shear rods 16 are embedded in the concrete of the first construction element 2 and in this way connected in a force-transmitting manner to the first construction element 2. The support angle bracket 17 is supported in horizontal direction directly on at least one compression rod 19 embedded in the first construction element 2. It can be provided that the support angle bracket 17 is fixedly connected to the at least one compression rod 19.

The first tension rods 9 comprise longitudinal axes 12 and the second tension rods 10 comprise longitudinal axes 13, as illustrated in FIG. 2. As shown in FIG. 1, the first tension rods 9 and the second tension rods 10 are arranged at the same level. The length axes 12 and 13 are positioned in a common horizontally extending plane 38. The plane 38 extends parallel to the length direction 28 and parallel to the transverse direction 29. The plane 38 extends perpendicularly to the upright direction 30. The tension rods 9 and 10 are arranged displaced relative to each other in the plane 38. As illustrated in FIG. 2, the longitudinal axes 12 and 13 of neighboring tension rods 9 and 10 have an offset relative to each other measured in the length direction 28.

The insulation body 5 comprises a bottom side 8 which in the installed state is arranged at the bottom, as shown in FIG. 1. The bottom side 8 extends approximately in a common plane with a bottom side 45 of the support angle bracket 17 and a bottom side 46 of the second construction element 3.

FIGS. 3 to 6 show the thermally insulating component 1 at the first construction element 2 in detail. The support angle bracket 17 of the thermally insulating component 1 comprises two legs 24 and 25 that are positioned at a right angle to each other in the embodiment. The legs 24 and 25 extend parallel to the length direction 28 of the insulation body 5. The first leg 24 extends parallel to the upright direction 30. The first leg 24 is advantageously vertically oriented in the installed state at the structure 50. At the side facing away from the insulation body 5, the first leg 24 forms a contact surface 22 for transmitting compressive forces. The second leg 25 extends parallel to the transverse direction 29 and is advantageously horizontally oriented in the installed state. At the side which is facing upwardly in the installation state, a support surface 23 for transmitting shear forces is formed at the second leg 25. As shown also in FIGS. 5 and 6, the second leg 25 of the support angle bracket 17 extends near the bottom side 8 of the insulation body 5. The second construction element 3 can be placed onto the support surface 23 and then fixed to the first construction element 2.

The shear rods 16 are embedded in the first construction element 2 and comprise a section 26 which extends at a slant to the upright direction 30 and at a slant to the transverse direction 29. In the installed state, the slanted section 26 extends downward away from the first construction element 2 toward the second construction element 3. The slanted sections 26 of the two shear rods 16 extend at the outer sides of the cheeks 18 facing away from each other. Each slanted section 26 is fixed directly to one of the cheeks 18, in the embodiment by welding. The slanted section 26 of the at least one shear rod 16 projects through the insulation body 5.

The two legs 24 and 25 are connected to each other by at least one cheek 18, in the embodiment by two cheeks 18. The cheeks 18 extend perpendicularly to the length direction 28. In the embodiment, the cheeks 18 are arranged at the two opposite ends of the legs 24 and 25 arranged in the length direction 28. The at least one cheek 18 comprises advantageously an approximately triangular shape. The cheek 18 comprises a top side 51 that connects the legs 24 and 25. Preferably, the topside 51 extends across at least a portion of its length in a straight line. The topside 51 of the cheek 18 extends advantageously in the viewing direction of the length axis 28 at a slant to the transverse direction 29, preferably at an angle of 30° to 60°. The slant angle of the topside 51 of the cheek 18 corresponds advantageously to the slant angle of the slanted section 26 of the shear rod 16.

In the illustrated embodiment, the support angle bracket 17 is arranged outside of the insulation body 5, namely at the longitudinal side 7 of the insulation body 5 facing away from the first longitudinal side 6. The support angle bracket 17 projects in this way into the region of the second construction element 3. At the side of the first leg 24 which is facing the insulation body 5, the first compression rods 19 are fixed to the first leg 24. The compression rods 19 are embodied as comparatively long straight rods which are embedded in the concrete of the first construction element 2 for compressive force transmission. The compression rods 19 can be screw-connected to the support angle bracket 17, welded thereto or fastened thereto in other ways.

As illustrated also in FIGS. 3 to 6, the straight sections of the shear rods 16 and the tension rods 9 are positioned approximately at the same level in the first construction element 2. This is also apparent from FIG. 1.

The configuration of the support angle bracket 17 and of the reinforcement elements arranged thereat, namely the two shear rods 16 and the two compression rods 19, is also illustrated in FIGS. 7 to 9 in detail. Advantageously, the support angle bracket 17 is comprised of metal. The support angle bracket 17, including the at least one cheek 18, is formed in particular of sheet metal, preferably of at least two sheet metal parts connected to each other.

As illustrated in FIG. 10, the slanted section 26 comprises an end 39. The end 39 is the end of the slanted section 26 that is arranged closer to the first longitudinal side 7 of the insulation body 5 than to the first longitudinal side 6. The other end of the slanted section 26 adjoins the straight section of the shear rod 16 which is to be embedded in the first construction element 2, as can be seen also in FIGS. 3 to 6. The end 39 comprises a distance fin relation to the bottom side 8 of the insulation body 5 that is measured in the upright direction 30. The distance f is preferably comparatively small. Advantageously, the distance f amounts to less than 5 cm, in particular less than 2 cm. The insulation body 5 comprises a height n measured in the upright direction 30. Advantageously, the distance f amounts to at most one fourth of the height n.

The first leg 24 of the support angle bracket 17 comprises a rear side 54 which is facing away from the second leg 25. In the embodiment, the at least one compression rod 19 is secured to the rear side 54. In the embodiment, the end 39 comprises a distance g in relation to the rear side 54 measured in the transverse direction 29. The distance g is advantageously relatively large. Advantageously, the distance g amounts to more than 2 cm, preferably more than 5 cm. Preferably, the distance f amounts to less than 80%, in particular less than 50%, of the distance g. The distance g in relation to the rear side 54 corresponds to the distance of the end 39 in relation to the insulation body 5 when the support angle bracket 17 is arranged with its rear side 54 at the second longitudinal side 7 of the insulation body 5.

As illustrated in FIG. 11, the slanted sections 26 are welded to the cheeks 18. The sections 26 are connected to the cheeks 18 by the weld seams 27. As also shown in FIG. 11, the cheeks 18 and the legs 25 are formed of a single sheet metal part that is angled at oppositely positioned sides out of the plane of the leg 25 in order to form the cheeks 18. The first leg 24 is advantageously embodied as a separate plate and connected to the cheeks 18 and the leg 25 by means of a weld seam 44, illustrated in FIG. 12.

As illustrated in FIG. 12, the support angle bracket 17 has a height h measured in upright direction 30 (FIG. 10). The cheek 18 extends advantageously across the entire height h measured in upright direction 30 of the support angle bracket 17. The region of the slanted section 26 extending along the cheek 18 extends across a comparatively large proportion of the height h of the support angle bracket 17. The slanted section 26 extends along the cheek 18 across a height i which amounts advantageously to at least 50%, in particular at least 70%, of the height h. The free end 39 comprises in relation to the bottom side 45 of the support angle bracket 17 a distance k in the embodiment. However, it can also be provided that the end 39 projects all the way to the bottom side 45. Advantageously, the distance k is smaller than 2 cm. Preferably, the distance k amounts to less than 30%, in particular less than 20%, of the height h.

Figure 13:
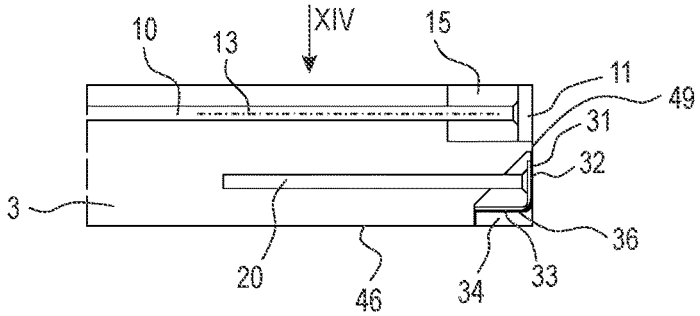
FIG. 13 shows a schematic section illustration of the second construction element.
Figure 14:
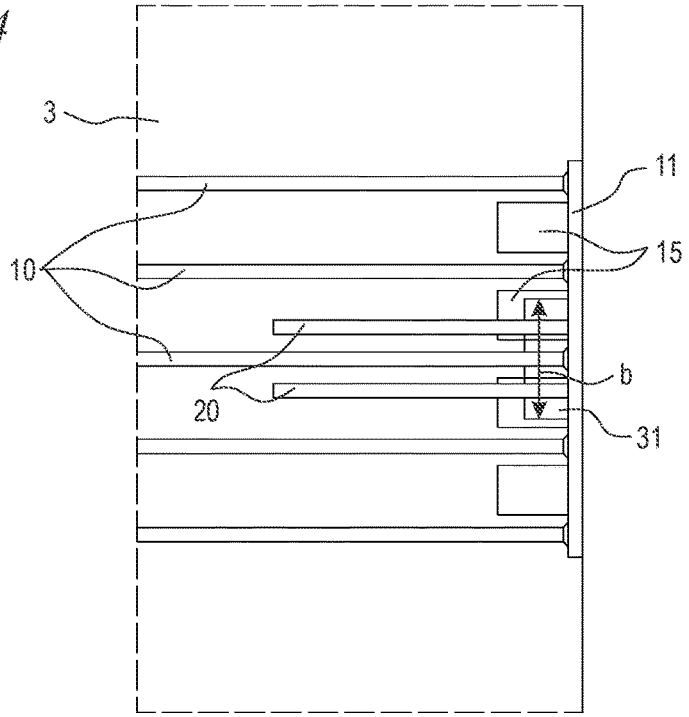
FIG. 14 is a schematic illustration of the second construction element and of the force-transmitting elements of the device arranged therein in a viewing direction of arrow XIV in FIG. 13.

FIGS. 13 and 14 show schematically the second construction element 3 with the elements for force transmission arranged thereat. For tensile force transmission, the second tension rods 10 as well as the connecting plate 11 connected to the second tension rods 10 are provided in the second construction element 3. For transmitting compressive forces and shear forces, a bearing angle bracket 31 is provided. Instead of the bearing angle bracket 31 provided in the embodiment, other types of bearing parts can be provided also for transmitting the horizontal compressive forces and the vertically oriented shear forces. Second compression rods 20 are fixed to the bearing angle bracket 31. The second compression rods 20 are embedded in the second construction element 3 and advantageously embodied as straight rods. A different configuration of the second compression rods 20 can also be advantageous. The bearing angle bracket 31 comprises a first bearing surface 32 which is oriented vertically in the installed state and serves for transmitting horizontally oriented compressive forces. The bearing angle bracket 31 comprises in addition a second bearing surface 33. The second bearing surface 33 is oriented perpendicularly to the first bearing surface 32 in the embodiment. The second bearing surface 33 extends advantageously parallel to the bottom side of the second construction element 3 and parallel to the longitudinal axis 13 of the tension rods 10 (FIG. 13).

The bearing angle bracket 31 is positioned in a formwork body 34 in the embodiment. The formwork body 34 is preferably embodied for arrangement at a formwork for producing the second construction element 3 and adjoins the bottom side 46 as well as the end face 49 of the second construction element 3 facing the insulation body 5 (FIG. 1) in the installed state.

As illustrated in FIG. 14, two second compression rods 20 are fixed to the bearing angle bracket 31 in the embodiment. The bearing angle bracket 31 comprises a length b which is measured parallel to the length direction 28 of the insulation body 5 (FIG. 1). The length b in the installed state is measured in the horizontal direction.

Figure 15:
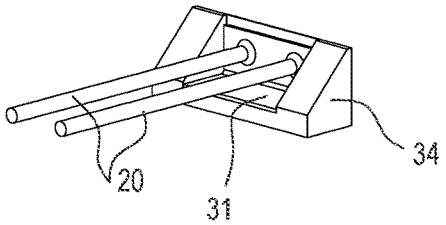
FIG. 15 shows in a perspective illustration a bearing angle bracket with the compression rods arranged thereat and the formwork body of the device.
Figure 16:
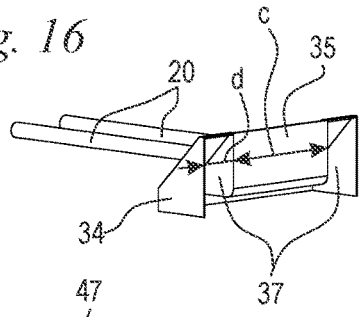
FIG. 16 shows in another perspective illustration the bearing angle bracket with the compression rods arranged thereat and the formwork body of the device.
Figure 17:
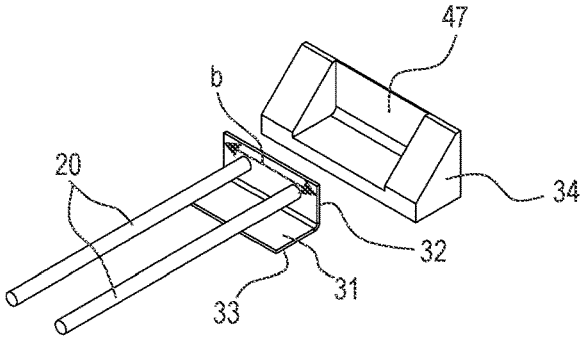
FIG. 17 shows a perspective exploded illustration of the arrangement of FIGS. 15 and 16.

FIGS. 15 to 17 show the bearing angle bracket 31 and the formwork body 34 in detail. At its side which is facing the concrete of the second construction element 3, the formwork body 34 comprises a receptacle 47 (illustrated in FIG. 17) in which the bearing angle bracket 31 is to be arranged. In the embodiment, the receptacle 47 is delimited by two recesses 37 which are arranged at oppositely positioned sides of the formwork body 34. The two recesses 37 comprise a distance c in relation to each other that is greater than the length b of the bearing angle bracket 31 so that the bearing angle bracket 31 can be positioned between the two recesses 37. The formwork body 34 is preferably an injection-molded part of plastic material.

As shown in FIG. 16, the formwork body comprises a first surface 35 which is provided for contacting the contact surface 22 of the support angle bracket 17 and for transmitting horizontally extending compressive forces. As shown in FIG. 13, the formwork body 34 comprises a second surface 36 which serves for contacting the support surface 23 and serves for transmitting shear forces.

The recesses 37 each comprise a width d. The width d of the recesses 37 is selected such that a cheek 18 can be positioned together with the slanted section 26 of a shear rod 16 arranged thereat in the recess 37. The width d is selected such in this context that positioning is easily possible even for conventional structure tolerances. As shown in FIG. 11, a cheek 18 and the slanted section 26 of the shear rod 16 arranged thereat have a total width e. The width d of each recess 37 is greater than the total width e. Preferably, the width d is only slightly larger than the total width e of the cheek 18 and the slanted section 26 so that the formwork body 34 effects positioning of the second construction element 3 at the thermally insulating element 1. The length b of the bearing angle bracket 31 is preferably only slightly smaller than the distance c between the recesses 37.

Figure 18:
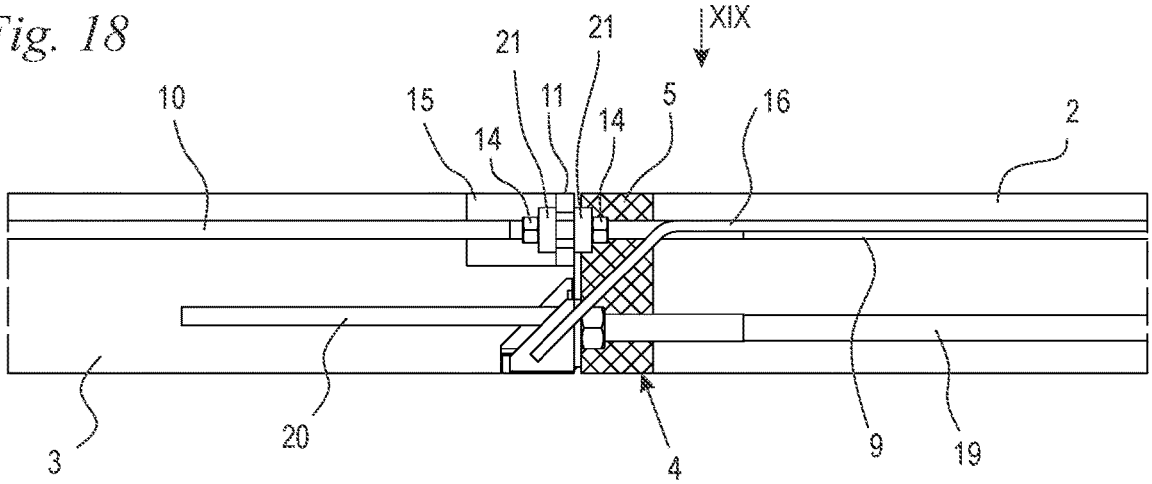
FIG. 18 shows in a schematic section illustration a further embodiment variant of a structure.
Figure 19:
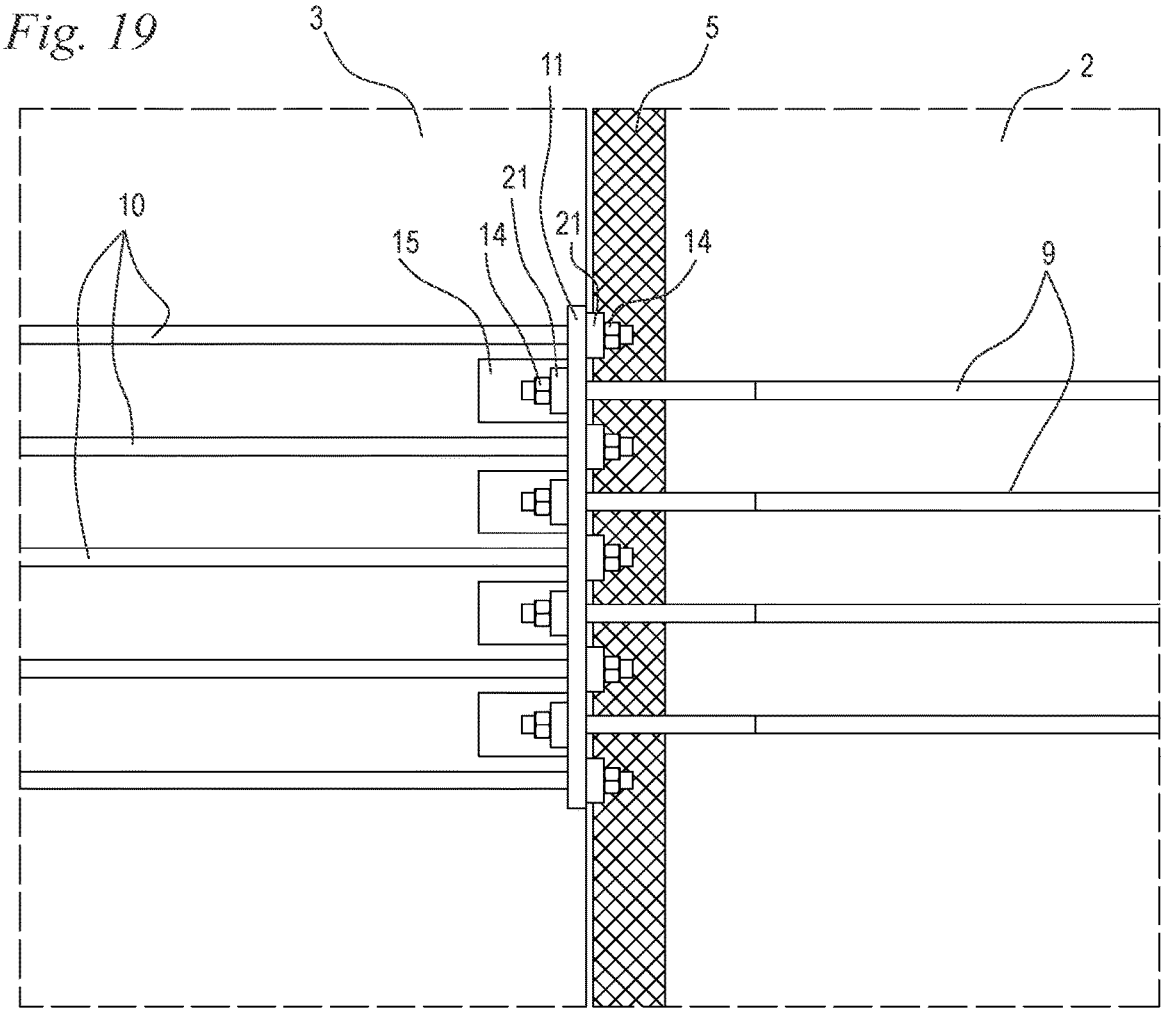
FIG. 19 shows in schematic illustration the tensile force-transmitting means of the structure according to FIG. 18 in the viewing direction of arrow XIX in FIG. 18.
Figure 20:
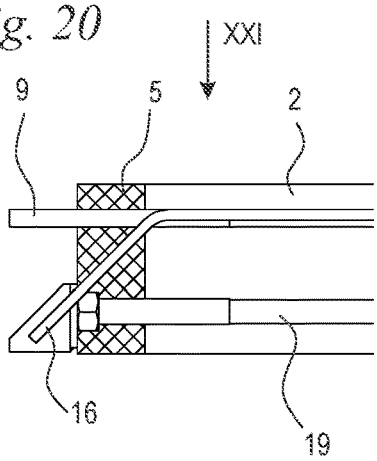
FIG. 20 is a schematic section illustration of an embodiment variant of the first construction element.
Figure 21:
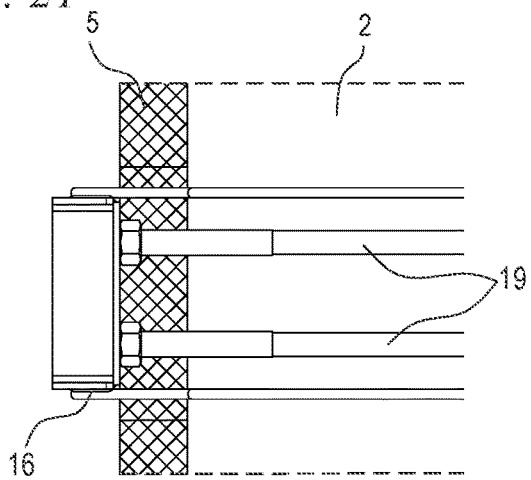
FIG. 21 is a schematic illustration in the viewing direction of the arrow XXI in FIG. 20.

FIGS. 18 and 19 show an embodiment variant in which the means for shear force transmission and for compressive force transmission are embodied in accordance with the preceding embodiment. The embodiment variant according to FIGS. 18 and 19 differs from the preceding embodiment variant in that the tension rods 10 as well as the tension rods 9 are fixed to the connection plate 11 by fastening nuts 14. In the embodiment, between each fastening nut 14 and the connection plate 11, a washer 21 is arranged. However, the washers 21 can also be dispensed with.

Figure 22:
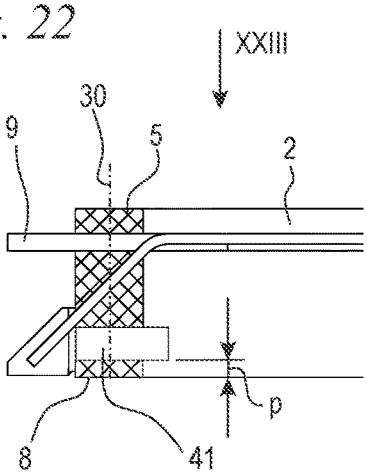
FIG. 22 is a schematic section illustration of a further embodiment variant of the first construction element.
Figure 23:
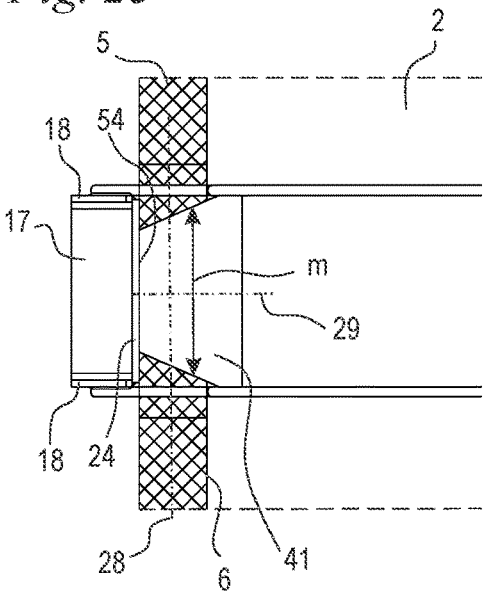
FIG. 23 is a schematic illustration in the viewing direction of arrow XXIII in FIG. 22.

FIGS. 20 to 25 show different embodiment variants for elements for compressive force introduction in the first construction element 2. In the embodiment according to FIGS. 20 and 21, the compressive force introduction is realized via compression rods 19. In the embodiment according to FIGS. 22 and 23, a compression bearing 41 for compressive force transmission is provided. The width m of the compression bearing 41 measured in length direction 28 is not constant in transverse direction 29 but increases from the support angle bracket 17 in the direction toward the first construction element 2. In this way, the surface for introducing compressive forces in the first construction element 2 is enlarged. In the embodiment, the compression bearing 41 projects past the insulation body 5 into the first construction element 2. However, it can also be provided that the compression bearing 41 ends at the first longitudinal side 6 of the insulation body 5 and contacts here the concrete of the first construction element 2 in order to introduce compressive forces into the first construction element 2. As illustrated in FIG. 22, the compression bearing 41 is positioned at a distance p in relation to the bottom side 8 of the insulation body 5 measured in the upright direction 30. The compression bearing 41 extends advantageously across a central region of the height of the support angle bracket 17. As shown in FIG. 23, the compression bearing 41 is positioned in length direction 28 approximately centrally at the rear side 54 of the support angle bracket 17. The compression bearing 41 supports the support angle bracket 17 at a central region between its cheeks 18. Since the width m of the compression bearing 41 increases toward the first construction element 2, a sufficiently large region of the concrete of the first construction element 2 can be activated for force introduction.

Usually, the second construction element 3 is comprised of concrete whose strength is greater than the strength of the concrete of the first construction element 2. The first construction element 2 can be manufactured, for example, of cast-in-place concrete and the second construction element 3 can be manufactured in a prefabrication plant. In this way, a smaller surface of the compression bearing 41 can provided for the force transmission at the second construction element 3 than at the first construction element 2.

Figure 24:
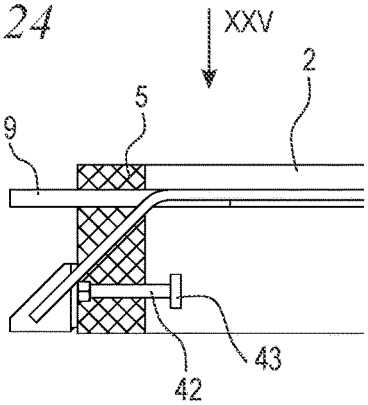
FIG. 24 is a schematic section illustration of a further embodiment variant.
Figure 25:
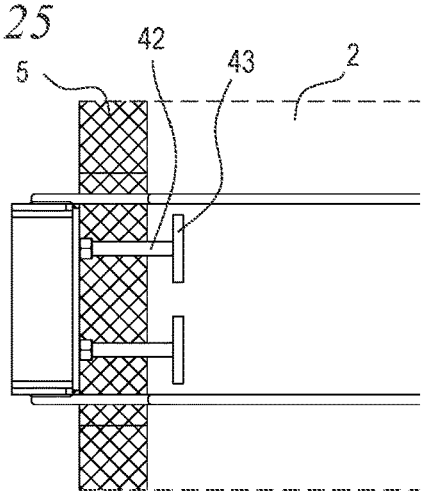
FIG. 25 is a schematic illustration in the viewing direction of arrow XXV in FIG. 24.

In the embodiment according to FIGS. 24 and 25, anchors 42 each comprising a widened head 43 are provided for compressive force transmission. In the embodiment, two anchors 42 are provided. The anchors 42 are comparatively short so that the arrangement is also suitable for installation in a first construction element 2 with minimal depth in this region.

Figure 26:
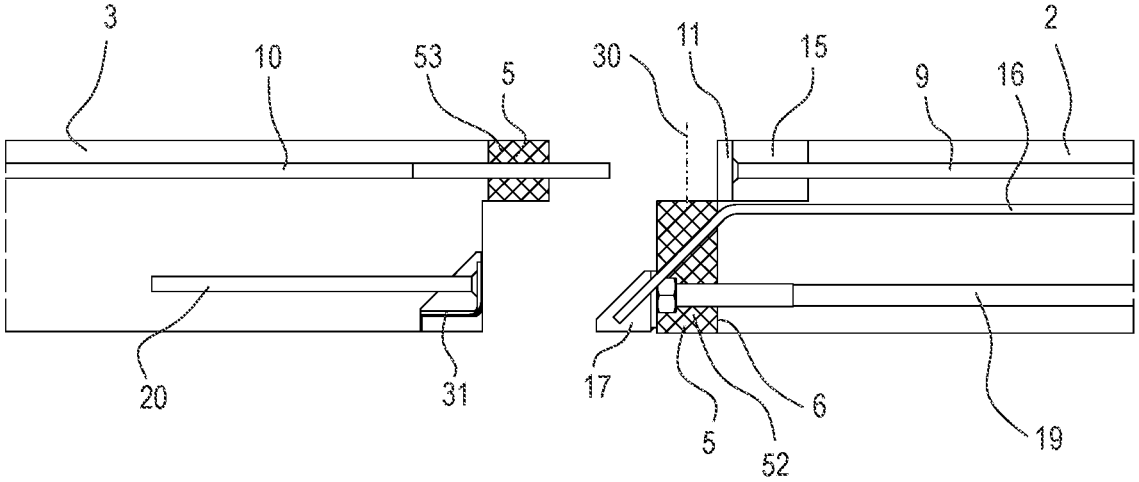
FIG. 26 is a schematic section illustration of a further embodiment variant of a structure with a device for connecting the second construction element to the first construction element prior to connecting the second construction element to the first construction element.

FIG. 26 shows an embodiment variant in which the second tension rods 10 project through the insulation body 5. The insulation body 5 in the embodiment is of a divided configuration. The first part 52 of the insulation body 5 is secured at the first construction element 2 and a second part 53 of the insulation body 5 is secured at the second construction element 3. In the embodiment, the first compression rods 19 and the shear rods 16 project through the first part 52 of the insulation body 5. The second tension rods 10 project through the second part 53 of the insulation body 5. A one-part or a multi-part configuration of the insulation body 5 and/or a different arrangement of the parts of the insulation body 5 can be advantageous as well. The support angle bracket 17 is arranged outside of the insulation body 5. In the viewing direction in length direction 28, the support angle bracket 17 and the insulation body 5 are positioned adjacent to each other and do not overlap.

The first tension rods 9 in the embodiment are welded to the connection plate 11; however, they can also be fixed by screws to the connection plate 11. The connection plate 11 is contacting the first longitudinal side 6 of the insulation body 5. Adjacent to the connection plate 11, the first construction element 2 has cutouts 15. The connection plate 11 comprises openings for the second tension rods 10; the second tension rods 10 are inserted through these openings into the cutouts 15 and screw-connected therein by means of fastening nuts 14 (FIG. 2).

Figure 27:
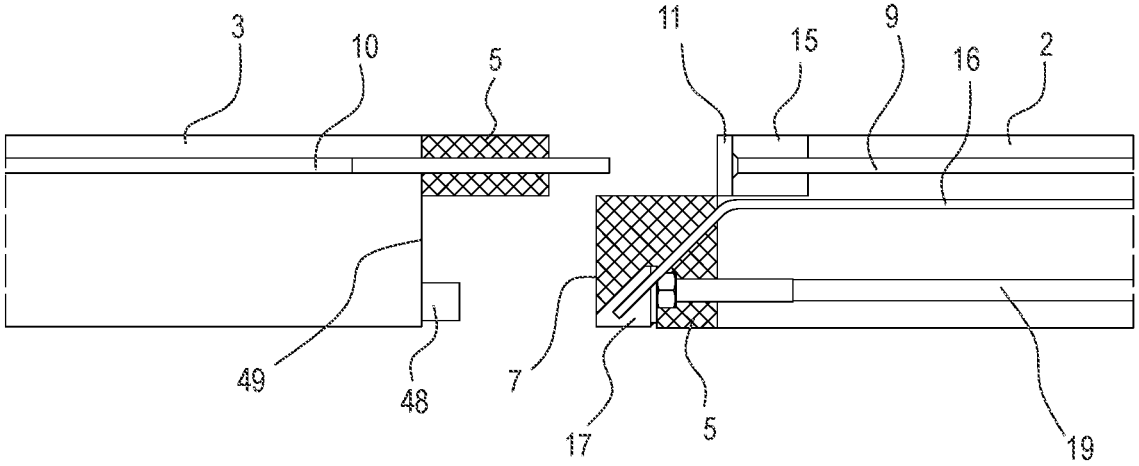
FIG. 27 is schematic section illustration of another embodiment variant of a structure with a device for connecting the second construction element to the first construction element prior to connecting the second construction element to the first construction element.

In the embodiment according to FIG. 27, the support angle bracket 17 is arranged in the insulation body 5, preferably in a corresponding receptacle of the insulation body 5. The second construction element 3 comprises an end face 49 which is facing the insulation body 5. In the embodiment according to FIG. 27, the end face 49 of the second construction element 3 comprises a bearing 48 that projects past the end face 49 into the insulation body 5 and can be comprised, for example, of concrete, in particular of ultrahigh strength concrete or of metal. The bearing 48 can be anchored in the second construction element 3 in a suitable manner, for example, by means of reinforcement elements, not illustrated. When the second construction element 3 is mounted at the first construction element 2, the bearing 48 is positioned in the support angle bracket 17 and the second tension rods 10 are pushed through corresponding openings in the connection plate 11 into cutouts 15 of the first construction element 2 and screw-connected therein.

The embodiments according to FIG. 26 and FIG. 27 show construction elements with enlarged thickness. The shear rods 16 do not extend here at the level of the first tension rods 9 in the first construction element 2 but at a distance thereto in upright direction 30.

Further advantageous embodiments result from any arbitrary combination of embodiments with each other.

The specification incorporates by reference the entire disclosure of German priority document 20 2021 000 466.1 having a filing date of Feb. 1, 2021.

While specific embodiments of the invention have been shown and described in detail to illustrate the inventive principles, it will be understood that the invention may be embodied otherwise without departing from such principles.

What is claimed is:

1. A device for thermally insulating, force-transmitting retrofitting of a second load-bearing construction element to a first load-bearing construction element, the device comprising:

an insulation body configured to be arranged in a construction joint between the first load-bearing construction element and the second load-bearing construction element;

tensile force-transmitting means;

compressive force-transmitting means;

shear force-transmitting means;

wherein the insulation body comprises a first longitudinal side configured to be arranged at the first load-bearing construction element and a second longitudinal side positioned opposite the first longitudinal side;

wherein the insulation body comprises a length direction, a transverse direction extending perpendicularly to the length direction and running from the first longitudinal side to the second longitudinal side, and an upright direction extending perpendicularly to the length direction and perpendicularly to the transverse direction;

wherein the compressive force-transmitting means comprise a contact surface accessible from the second longitudinal side of the insulation body and configured to absorb horizontal compressive forces of the second load-bearing construction element;

wherein the compressive force-transmitting means further comprise a compressive force element extending at least to the first longitudinal side of the insulation body and force-transmittingly connected to the contact surface;

wherein the shear force transmitting means comprise a support surface accessible from the second longitudinal side of the insulation body and configured to absorb vertically oriented forces of the second load-bearing construction element;

wherein the shear force transmitting means further comprise a first shear rod connected force-transmittingly to the support surface;

a support angle bracket comprising a first leg, a second leg, and a first cheek arranged transversely to a length direction of the insulation body and connecting the first leg and the second leg to each other, wherein the first leg forms the contact surface and the second leg forms the support surface;

wherein the first shear rod comprises a slanted section extending at a slant to the upright direction, wherein the slanted section of the first shear rod is fixed directly to the first cheek.

2. The device according to claim 1, wherein the slanted section of the first shear rod comprises an end facing away from the first longitudinal side of the insulation body, wherein the end is arranged at the first cheek and comprises a distance in relation to a bottom side of the insulation body measured in an upright direction relative to the bottom side of the insulation body, wherein the distance amounts to less than 5 cm.

3. The device according to claim 1, wherein the slanted section of the first shear rod comprises an end facing away from the first longitudinal side of the insulation body, wherein the first leg comprises a rear side facing away from the second leg, and wherein the end is arranged at the first cheek and comprises a distance in relation to the rear side measured in the transverse direction, wherein the distance amounts to at least 2 cm.

4. The device according to claim 1, wherein the slanted section of the first shear rod comprises an end facing away from the first longitudinal side of the insulation body, wherein the first leg comprises a rear side facing away from the second leg, wherein the end is arranged at the first cheek, wherein the end comprises a first distance in relation to a bottom side of the insulation body measured in an upright direction relative to the bottom side of the insulation body, and wherein the end further comprises a second distance in relation to the rear side measured in the transverse direction, wherein the first distance is smaller than the second distance.

5. The device according to claim 1, wherein the support angle bracket comprises a second cheek arranged transversely to the length direction of the insulation body and connecting the first leg and the second leg to each other, wherein the first cheek and the second cheek are arranged at opposite ends of the support angle bracket, wherein the shear force transmitting means further comprise a second shear rod connected force-transmittingly to the support surface, wherein the second shear rod comprises a slanted section extending at a slant to the upright direction, wherein the slanted section of the second shear rod is fixed directly to the second cheek.

6. The device according to claim 1, wherein the support angle bracket is at most partially in overlap with the insulation body in a viewing direction along the length direction.

7. The device according to claim 1, further comprising a bearing part configured to be embedded in the second load-bearing construction element, wherein the bearing part comprises a first bearing surface and a second bearing surface, wherein the first bearing surface is configured to transmit compressive forces oriented in the transverse direction to the support angle bracket, and wherein the second bearing surface is configured to transmit shear forces oriented in the upright direction to the support angle bracket.

8. The device according to claim 7, wherein the bearing part is a bearing angle bracket and wherein the second bearing surface is oriented perpendicularly to the first bearing surface.

9. The device according to claim 7, wherein the bearing part is configured to fix thereat at least one reinforcement element.

10. The device according to claim 9, wherein the at least one reinforcement element is a compression rod.

11. The device according to claim 1, further comprising a formwork body comprising a first surface configured to be supported on the contact surface of the support angle bracket and further comprising a second surface configured to be supported on the support surface of the support angle bracket, wherein the formwork body further comprises a first recess configured to receive the first cheek and the slanted section of the first shear rod fixed at the first cheek.

12. The device according to claim 11, further comprising a bearing part configured to be embedded in the second load-bearing construction element and comprising a length measured in the length direction of the insulation body, wherein the formwork body comprises a second recess configured to receive a second cheek of the support angle bracket, wherein the first recess and the second recess are spaced apart from each other at a distance measured in the length direction, wherein the length of the bearing part is smaller than the distance at which the first recess and the second recess are spaced apart from each other.

13. The device according to claim 1, wherein the tensile force-transmitting means comprise first tension rods and second tension rods, wherein the first tension rods and the second tension rods are force-transmittingly connected to each other.

14. The device according to claim 13, wherein the first tension rods and the second tension rods are arranged in a common plane extending perpendicularly to the upright direction.

15. The device according to claim 13, further comprising a connection plate, wherein the first tension rods and the second tension rods are connected to the connection plate.

16. The device according to claim 1, wherein one of the first and second load-bearing construction elements is a building ceiling and the other one of the first and second load-bearing construction elements is a balcony slab.

17. A structure comprising:

a first load-bearing construction element of concrete;

a second load-bearing construction element of concrete;

a device for thermally insulating, force-transmitting retrofitting of the second load-bearing construction element to the first load-bearing construction element, the device comprising:

an insulation body configured to be arranged in a construction joint between the first load-bearing construction element and the second load-bearing construction element;

tensile force-transmitting means;

compressive force-transmitting means;

shear force-transmitting means;

wherein the insulation body comprises a first longitudinal side configured to be arranged at the first load-bearing construction element and a second longitudinal side positioned opposite the first longitudinal side;

wherein the insulation body comprises a length direction, a transverse direction extending perpendicularly to the length direction and running from the first longitudinal side to the second longitudinal side, and an upright direction extending perpendicularly to the length direction and perpendicularly to the transverse direction;

wherein the compressive force-transmitting means comprise a contact surface accessible from the second longitudinal side of the insulation body and configured to absorb horizontal compressive forces of the second load-bearing construction element;

wherein the compressive force-transmitting means further comprise a compressive force element extending at least to the first longitudinal side of the insulation body and force-transmittingly connected to the contact surface;

wherein the shear force transmitting means comprise a support surface accessible from the second longitudinal side of the insulation body and configured to absorb vertically oriented forces of the second load-bearing construction element;

wherein the shear force transmitting means further comprise a shear rod connected force-transmittingly to the support surface;

a support angle bracket comprising a first leg, a second leg, and a cheek arranged transversely to a length direction of the insulation body and connecting the first leg and the second leg to each other, wherein the first leg forms the contact surface and the second leg forms the support surface;

wherein the shear rod comprises a slanted section extending at a slant to the upright direction, wherein the slanted section of the shear rod is fixed directly to the cheek;

wherein the insulation body is arranged in a construction joint between the first load-bearing construction element and the second load-bearing construction element;

wherein the first longitudinal side of the insulation body is arranged at the first load-bearing construction element;

wherein the second load-bearing construction element is supported on the contact surface and the support surface in relation to the first load-bearing construction element; and wherein a section of the shear rod projecting past the insulation body into the first load-bearing construction element is embedded in the concrete of the first load-bearing construction element.

18. The structure according to claim 17, wherein one of the first and second load-bearing construction elements is a building ceiling and the other one of the first and second load-bearing construction elements is a balcony slab.

19. The structure according to claim 17, wherein the support angle bracket in a viewing direction along the length direction does not overlap the insulation body, and wherein the second load-bearing construction element comprises a recess open toward a bottom side and an end face of the second load-bearing construction element, wherein the recess is configured to receive the cheek of the support angle bracket.

20. The structure according to claim 17, further comprising a connection plate arranged at one of the first and second load-bearing construction elements, wherein the first load-bearing construction element comprises first tension rods embedded in the concrete and the second load-bearing construction element comprises second tension rods embedded in the concrete, wherein the first tension rods and the second tension rods are connected to the connection plate and are connected to each other through the connection plate, wherein said one of the first and second load-bearing construction elements comprises cutouts adjacent to the connection plate, wherein the first tension rods or the second tension rods projecting through the insulating body and through the connecting plate into the cutouts are screw-connected to the connection plate in the cutouts.

* * * * *